United States Patent [19]

Thomas

[11] Patent Number: 4,906,323

[45] Date of Patent: Mar. 6, 1990

[54] CARPET STRIPPING ASSEMBLY

[76] Inventor: Philip D. Thomas, 2270 SE. Old Dixie Hwy., Vero Beach, Fla. 32962

[21] Appl. No.: 299,925

[22] Filed: Jan. 19, 1989

[51] Int. Cl.[4] ..... B32B 31/16

[52] U.S. Cl. ..... 156/584; 156/344; 254/200

[58] Field of Search ..... 24/521; 156/344, 584; 254/209, 211, 200, 202; 294/8.6

[56] References Cited

U.S. PATENT DOCUMENTS 1,971,218 8/1934 Hoobler ..... 254/211

4,533,118 8/1985 Thomas et al. ..... 156/584 X 4,560,146 12/1985 Thomas et al. ..... 156/344 X 4,601,776 7/1986 Kral ..... 156/584

*Primary Examiner*—Robert A. Dawson

*Attorney, Agent, or Firm*—Malloy & Malloy

[57] ABSTRACT

A gripping assembly designed for the stripping or removing of adhesively secured carpeting from a floor surface which includes a pulling assembly designed to fit around the torso or other applicable portion of the body of one removing the carpet such that the user can use the legs and thereby exert maximum pulling force on the gripping assembly to strip the carpet from the floor.

16 Claims, 2 Drawing Sheets

FIG. 4
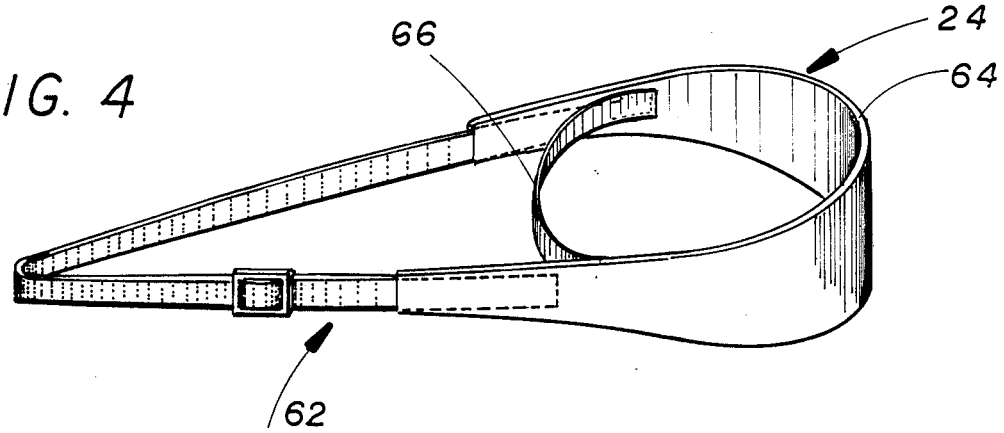
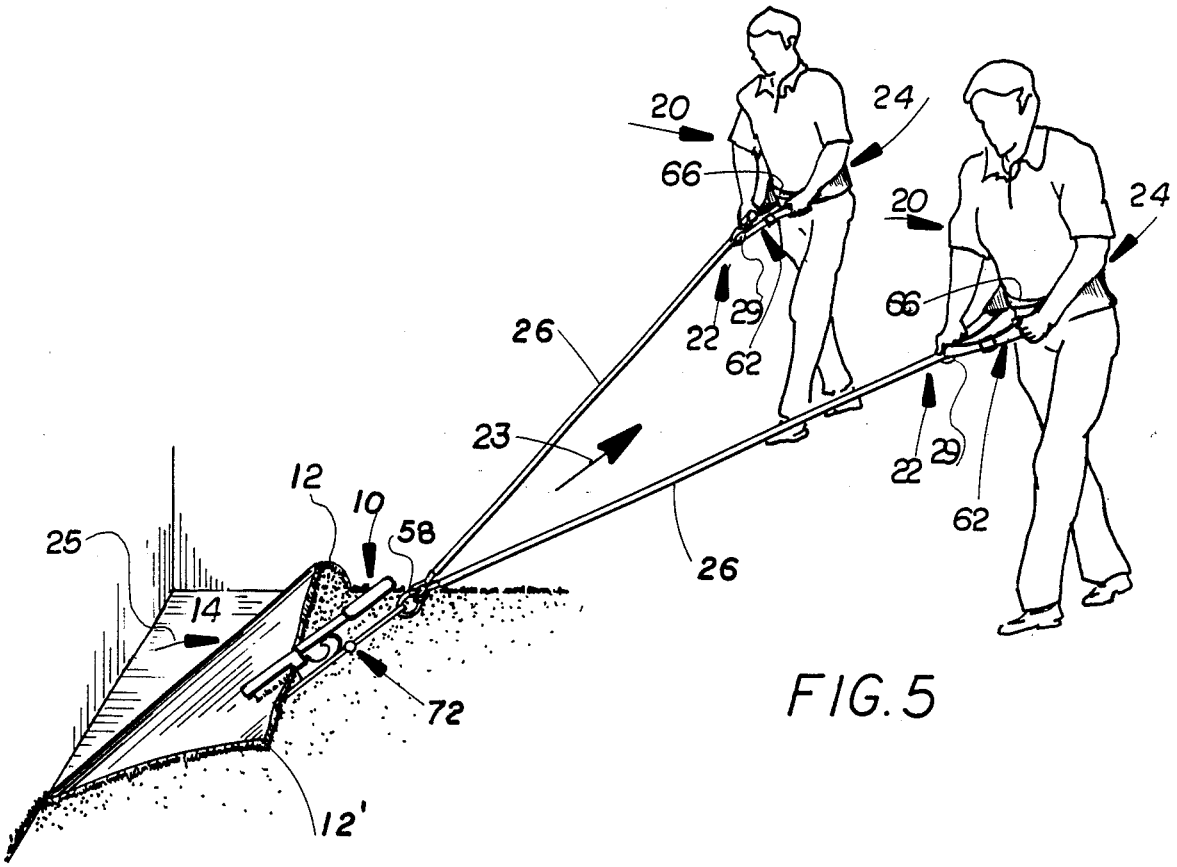
FIG. 5

CARPET STRIPPING ASSEMBLY

BACKGROUND OF THE INVENTION

1. Field of the Invention

This invention relates to a gripping and pulling assembly used to strip adhesively mounted or otherwise fixedly secured carpeting from a floor surface incorporating a pulling harness attached to a gripping structure for engagement with a users body such that the user may exert as much pulling force as possible on the carpet being removed thereby eliminating the need for winches or other mechanical pulling devices.

2. Description of the Prior Art

In large industrial and commercial complexes, where carpet is used as a primary floor covering over generally very large floor areas, it is common to adhere or affix the under surface of the carpeting directly to the exposed surface of the floor. This is usually done by an adhesive or like material distributed substantially over the entire surface to be covered. This type of installation is considered necessary in high-traffic areas.

While effective for maintaining carpet for long periods of time, it has been realized that the removal of adhesively secured carpeting from floor surfaces is extremely difficult Removal is required due to replacement or repair. Prior art attempts to accomplish such removal are still extremely time consuming and manually very difficult. In removing adhesively secured carpets from floor surfaces, the prior art has primarily relied on equipment designed to remove a rubber-back carpeting normally secured to the floor surface by a multi-purpose adhesive which exhibits a bonding or holding strength much less than the extremely strong adhesive currently used to secure jute back carpets to flooring surfaces.

My existing U.S. Pat. No. 4,560,146 is directed to a stripper assembly for removing carpet which is directly adhered by adhesive and incorporating a gripping mechanism secured to the carpet and used in combination with an anchored, driving assembly in the form of a mechanical winch interconnected to the gripping structure and the carpeting being removed by a cable or like pulling device. Activation of the winch causes a pulling force to be exerted on the gripping structure and steadily pulls and thereby strips the carpet from the surface to which it was adhered. While applicable for its intended function, other applications involving the removal of carpeting from perhaps smaller areas or from homes frequently does not lend itself to the use of the mechanical winch and accompanying anchoring assembly as outlined in the above-noted patent.

Accordingly, there is a need for the removing of adhered carpeting from flooring surfaces in areas which because of the expense, size, etc. does not as readily lend itself to the use of mechanical equipment including powered winches to apply the pulling force to the carpeting being stripped.

SUMMARY OF THE INVENTION

The present invention is directed towards a stripping assembly designed to remove adhesively secured or otherwise permanently attached carpeting, especially jute back carpeting from a floor surface to which it is attached. It is well known in the industry that extreme force is required to remove such adhesively secured carpeting. Therefore, the gripping assembly of the present invention comprises a gripping means designed to removably be secured in firm gripping engagement with an edge portion or other applicable portion of the carpeting which is initially peeled back, by hand or tools from the wall or its secured position in covering relation to the floor surface. Once free therefrom, the gripping means, preferably comprising a gripping jaw, is secured to the freed portion edge.

The gripping means includes a base wherein the gripping jaw is attached at one end thereof. The opposite end of the base is attached to a pulling means. An important feature of the present invention is the adaptation and structure of the pulling means so as to easily mount it in surrounding and secured relation to a preferred portion of the users body. More specifically, the pulling means includes some type of body engaging harness preferably in the form of a band which is disposed in at least partially surrounding relation to the mid-portion or hip area of the torso of the wearer. The pulling means further comprises at least one elongated connecting strap. The one connecting strap has one distal end removably secured to the base of the gripping means and an opposite or proximal end removably to the secured pulling means. By virtue of the harness and its interconnection to the gripping means using the connecting strap, the wearer my effectively utilize the force of the larger muscles in his legs as well as his entire body as he "leans" in a direction away from the carpet being stripped and "against" the harness. In actual use, the harness has a cushion portion as to be more comfortable to the user of the subject assembly. The cushion portion of the harness, set forth above, surrounds the mid-torso of the user and the cushion portion thereof substantically engages the lower back area such that when a pulling force is exerted on the gripping means by interconnection of the harness through one connector strap, the user is effectively facing the gripping means and exerts force thereon by leaning rearwardly and further using the leg or thigh muscle to exert a maximum pulling force.

Another feature of the present invention is a handle means secured to the base including two handle members each extending linearly outward in transverse relation from the base on opposite sides thereof. Each handle member is deposed to allow gripping engagement by a different hand of the user of the subject assembly. In accordance with this structural feature of the invention, another embodiment comprises using a second connector strap which is significantly shorter then the first connector strap. The second connector strap is of a sufficient length to connect to the base at a distance which would still allow the handle means secured to the base to be gripped by the hands of the user. Therefore, when the user uses the second connector strap instead of the first connector strap both the muscles of the legs as well as the muscles of the arms are used to exert a pulling force against the gripping means and the carpet being stripped from the floor.

Other features associated with the gripping means, include a lever handle pivotally connected to the gripping means by an appropriately structured hinge assembly which allows selective positioning of the lever handle in either an open or a closed and locked position. In the locked position, the gripping means is structured so as to eliminate the possibility of inadvertent dislodgment or detachment of the carpeting from a firm fixed engagement with the jaws thereof.

The invention accordingly comprises the features of construction, a combination of elements and an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
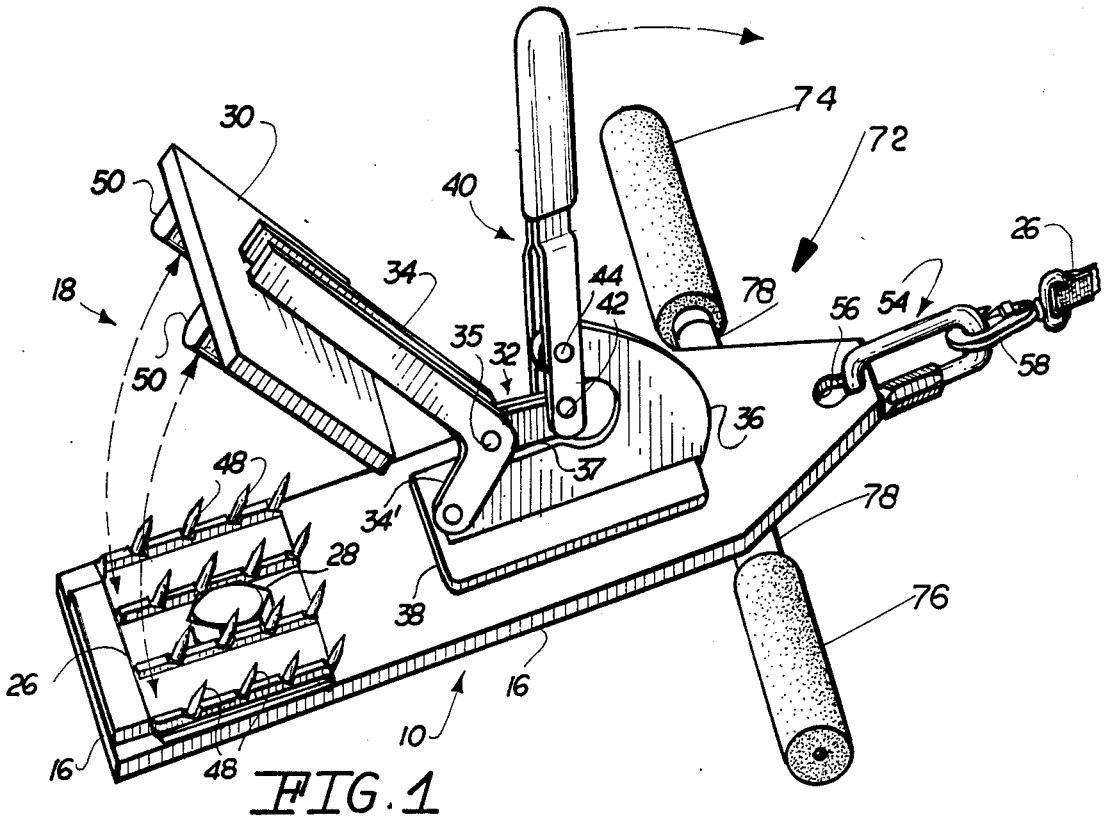
FIG. 1 is a perspective view In partial cut-away of the gripping means of the present invention.
Figure 2:
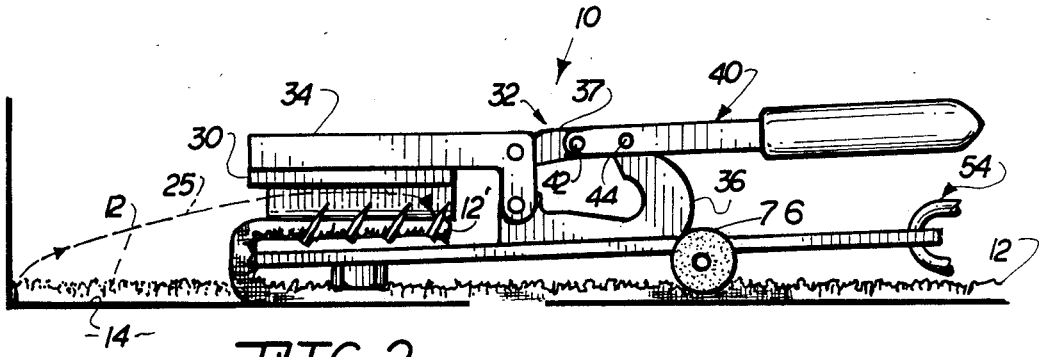
FIG. 2 is a longitudinal side view of the structure of FIG. 1 shown in gripping engagement with a carpeting portion being stripped from a floor surface.
Figure 3:
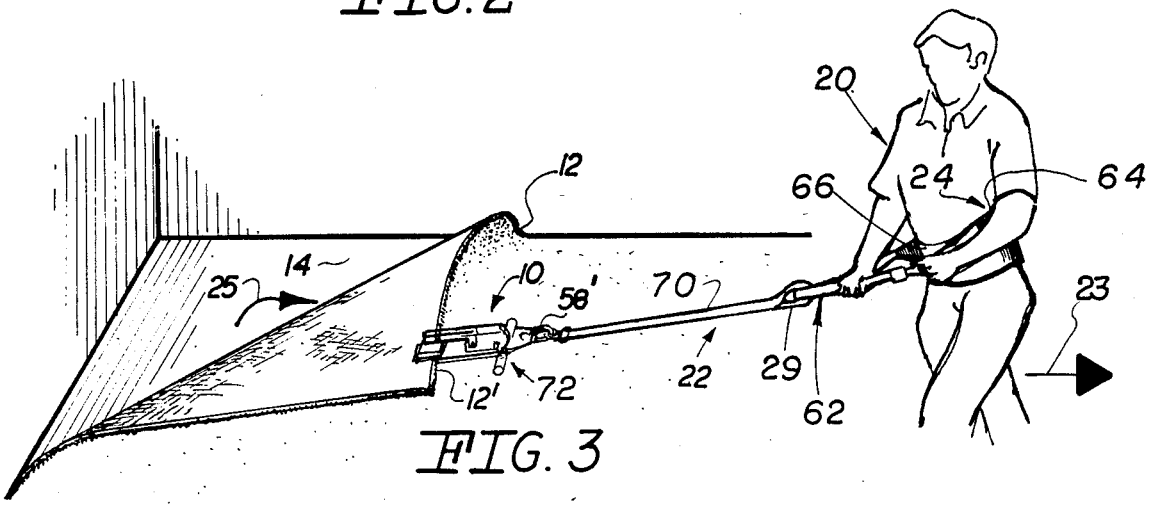
FIG. 3 is a perspective view wherein the gripping assembly is shown mounted on a pulling wearer by means of an appropriately structured harness which is part of the pulling assembly of the present invention.

As shown in FIGS. 1 through 3, the present invention relates to a stripping assembly including a gripping means 10 for stripping or removing carpeting 12 from its covering position relative to a floor surface 14 particularly of the type wherein the carpeting 12 is secured to the floor surface 14 by means of adhesive or any other applicable means.

The pulling assembly of the present invention includes the gripping means 10 having a base 16 to which a gripping jaw generally indicated as 18 is attached. The gripping jaw is specifically designed to be removably secured preferably to one edge or other portion of the carpet which has been peeled away from the floor surface either by the hand of the user 20 or by using any type of hand manipulatable tool or the like. Once the edge 12' is free, it is fixedly secured to the gripping jaw 18.

The stripping assembly of the present invention further includes a pulling assembly generally indicated as 22 and at least partially defined by a harness means 24 and at least one elongated connecting strap 26.

As is clearly pictured in FIG. 3, once the gripping means 10 and more specifically the gripping jaw 18 is secured into its gripping, locked position as shown in FIG. 2, the user or wearer 20 mounts the harness means 24 in an appropriate location on his body and preferably about one lower back and generally the lower torso area. Pulling force is exerted by effectively "leaning" rearwardly against the harness in a direction in accordance with the directional arrow 23 away from the carpeting 12, while facing the gripping means as shown. A stripping force will be exerted directly on the carpet and it will be readily removed from the floor surface 14 to which it is has been adhered in accordance with the directional arrow 23.

Details of the components of the present stripping assembly include the elongated rigid material base 16 being formed preferably from a metallic or high-strength material and having the gripping jaw 18 located and mounted at least preferably at one end thereof. The gripping jaw includes a first member 26 rigidly mounted adjacent one end 16' of the base 16 in communicating relation to the carpet portion being stripped as at 12'. The first member 26 of the gripping jaw 18 may be fixedly secured as by bolting or any other appropriate means of securing to the upper exposed surface of the base 16 as shown in both FIGS. 1 and 2. A proper connecting bolt as at 28 may be applied as is shown. The gripping jaw 18 further includes a second movable member 30 movably mounted on base 16 in registered cooperative relation with the first member 26 through the workings of a hinge assembly generally indicated as 32. An elongated arm support 34 has the second member 30 fixedly mounted thereon. One end of the arm 34 is pivotally attached to a fixed support 36 itself being fixedly secured to the exposed surface of the base 16 by a mounting plate or like mounting assembly as at 38. The hinge assembly includes a movable hinge link pivotal both to the appropriate end 34' of the mounting arm 34 as at 35 and to a corresponding end of a lever handle generally indicated as 40 wherein the pivotal connection between the link 37 and the lever handle 40 is at 42. The lever handle itself is pivotally mounted as at 44 onto a spaced apart portion of the fixed support 36 as is clearly shown in FIG. 1. By virtue of the hinge structure 32 and the pivotal interconnection of the lever handle 40 and the support arm 34 affixed to the second jaw member 30, the jaw member 30 may be selectively disposed between an open position as shown in FIG. 1 and a closed, locked position as shown in FIG. 2.

The gripping jaw 18 further comprises a plurality of teeth 48 having an outer substantially sharpened or pointed end to facilitate penetration of a portion of the carpeting as at 12' (see FIG. 2). The plurality of teeth 48 are arranged in parallel spaced-apart rows as is best shown in FIG. 1. At least one but preferably a plurality of elongated retainer members 50 are fixedly secured to move with the second member 30 on an inner face thereof and are cooperatively mounted relative to one another and to the rows of teeth on the first member 26 so as to be positioned between adjacent rows of teeth in engaging relation to the carpet end 12' being gripped. As is apparent from review of FIGS. 1 and 2, the retaining members secure the carpet into their gripped penetrated engagement by the plurality of teeth 48 and insure that the carpet will not easily become inadvertently disengaged therefrom.

The opposite end of base 16 has a connector as at 54 attached thereto preferably through the provision of an aperture 56. A snap hook or like cooperating connector element 58 is secured to a proximal end of the elongated connecting strap 26 and serves to interconnect the harness means 24 to the gripping means 10 and more specifically to the base 16. As is pictured in FIG. 3, the proximal end of strap 26 as at 29 is secured to a mounting assembly generally indicated as 62 and including an elastic band or strip 63 which may be defined as part of the harness means 24 and serves to facilitate mounting of the harness means 24 in at least partially surrounding relation to the user or wearer 20.

In a preferred embodiment, the harness means 24 is in the form of an elongated and at least partially padded or cushioned band 64 which, as set forth above, is designed to engage and allow pulling stress to be exerted thereon when the band 64 is surrounding and engaging one back and the hips or generally lower torso portion of the wearer while facing in a direction downward the gripping means. Obviously, the dimension and configuration of the band 64 and the fact that it is partially padded, allows greater versatility in choice of placement of the portion of the body on which the waist band 64 is located. This allows the wearer or user 20 to exert the maximum amount of force depending upon the orientation of the carpeting 12 or whatever space or volume limitations are present in the area from which the carpeting is being removed.

In another embodiment of the present invention a second connector strap 70 is used in addition to the connector strap 26. The second connector strap 70 is of a significantly shorter length and has a specific longitudinal dimension such that a pulling force can be exerted on the gripping assembly by the arms of the user gripping the handle member 74 and 76 while at the same time the harness means 24 engaging the back portion of the torso exerts an additional pulling force in the same manner as when the connecting strap 26 was utilized. Obviously the connecting strap 26 as shown in FIG. 3 is to long to allow simultaneous gripping of the handle means 72 by the hands and arms of the user.

In actual use the longer connecting strap 26 may first be connected to the connector element 54 through any type of snap type connector element 58. The length of the first connector strap 26 is sufficient to allow the user to at least partially stand up and thereby exert sufficient leverage to initially separate a sufficient portion of the carpet from the floor to which it is attached. Once the user is in a substantially full standing position, he can then change connector straps and disconnect connecting strap 26 and connect the second connecting strap 70. As set forth above the shorter length of the second connecting strap 70 allows the user to grip the handle means 72 while concurrently exerting a pulling force through the harness means 24. The second connecting strap 70 also has a snap type connector 58 prime as clearly shown.

Now that the invention has been described, What is claimed is:

1. A stripping assembly designed to remove adhesively attached or similarly secured carpeting from a floor surface, said assembly comprising:

a. a gripping means for gripping a portion of the carpeting being removed and including a base and a gripping jaw mounted thereon in attachable relation to the carpeting, b. said gripping jaw mounted substantially on one end of said base and being structured to be removably attached to the carpeting, c. a pulling means connected to said base for applying a stripping force to the carpeting when said gripping means is attached thereto, d. said pulling means comprising a harness means structured for removable attachment to a person and at least one elongated connecting strap, e. said connecting strap secured at one end thereof to said base and having an opposite end thereof secured to said harness means, f. said harness means and said one connecting strap structured and cooperatively disposed relative to said gripping means to exert a pulling force on the carpeting by a person wearing said harness means.

2. An assembly as in claim 1 wherein said gripping jaw is mounted on said base adjacent one end thereof, said connecting strap secured to said base in a substantially opposed position relative to said gripping jaw.

3. An assembly as in claim 2 wherein said gripping portion disposed in adjacent relation to a trailing end of said base in connectable relation to the carpeting.

4. An assembly as in claim 3 wherein said connecting strap is connected to extend outwardly from a leading end of said base towards the pulling wearer of said harness means.

5. An assembly as in claim 4 wherein said harness means is configured and dimensioned to engage and substantially surround a body of the pulling wearer.

6. An assembly as in claim 5 wherein said harness means comprises a waist band of sufficient length and dimension to at least partially surround the waist of the wearer.

7. An assembly as in claim 6 further comprising an elastic material mounting member connected to and cooperatively disposed to engage and stabilize said waist band about the waist of the wearer.

8. An assembly as in claim 1 wherein said harness means is configured and dimensioned to engage and substantially surround the body of the pulling wearer and comprises a waist band of sufficient length and dimension to accomplish said at least partially surrounding disposition about the waist of the wearer.

9. An assembly as in claim 1 wherein said gripping means further comprises a handle structure secured to said base and extending laterally outward therefrom in substantially transverse relation to said base.

10. An assembly as in claim 9 wherein said handle structure comprises two handle members each extending laterally outward from opposite sides of said base in a transverse relation to the direction of force exerted on the carpeting.

11. An assembly as in claim 1 wherein said gripping jaw comprises a first member secured to said base and a second member movably mounted relative to said first member and selectively positionable into and out of gripping engagement with the carpeting when disposed between said first and said second members.

12. An assembly as in claim 11 wherein said gripping jaw further comprises a lever handle hingedly connected to said second member in controlling movable relation thereto, said second member selectively positionable into and out of said gripping position by manipulation of said lever handle.

13. An assembly as in claim 12 further comprising a hinge assembly movably attached to and interconnecting both said lever handle and said second member and structured to maintain said second member into said gripping position when said lever handle is selectively positioned.

14. An assembly as in claim 11 wherein a plurality of teeth structured for penetrating engagement with the carpeting are formed in spaced apart parallel rows on one of said first or second member, the other of said first or second member having elongated retaining members formed thereon and disposed to be positioned in retaining relation to the penetrated, gripped carpeting on said teeth, said retaining members disposed in spaced-apart relation to one another a sufficient distance to pass between adjacent rows of said plurality of teeth when said first and second members are disposed in carpeting gripping position.

15. An assembly as in claim 14 wherein said retaining members are elongated fingers extending in substantially parallel relation to said rows of teeth and having a longitudinal dimension substantially equal thereto.

16. An assembly as in claim 1 further comprising a handle means secured to said base and extending outwardly there from in a position adaptable for gripping by both hands of a user, a second connecting strap having a longitudinal dimension shorter than the longitudinal dimension of said one connecting strap and specifically dimensioned to allow concurrent gripping by the user of the handle means while exerting a force on the gripping means by inner connection of the user with the harness means through said second connecting strap.

* * * * *